United States Patent [19]

Latimer

[11] 4,323,216

[45] Apr. 6, 1982

[54] BALANCED SUPPORT PLATES

[75] Inventor: John P. Latimer, Newport News, Va.

[73] Assignee: Deepsea Ventures, Inc., Gloucester Point, Va.

[21] Appl. No.: 111,165

[22] Filed: Jan. 10, 1980

[51] Int. Cl.[3] ..... A47H 1/114

[52] U.S. Cl. ..... 248/550

[58] Field of Search ..... 24/263 D; 248/550

[56] References Cited

U.S. PATENT DOCUMENTS

| | | | |
|---|---|---|---|
| 2,248,730 | 7/1941 | Wood | 248/550 |
| 3,990,668 | 11/1976 | Thompson et al. | 248/550 |
| 4,057,212 | 11/1977 | Schubert | 248/550 |

*Primary Examiner*—Doris L. Troutman

*Attorney, Agent, or Firm*—Barry G. Magidoff

[57] ABSTRACT

This invention provides apparatus for supporting extremely heavy weights, such as a lengthy horizontal pipe string for ocean floor mining or dredging, from a downwardly facing horizontal ledge surface. The apparatus comprises a plurality of relatively narrow structurally independent support segments which are capable of reciprocal horizontal radial movement towards and away from the object to be supported. One end of each support segment is pivotally supported by a support platform, and the second end portion is floatingly supported by a biasing support element, e.g., an hydraulic jack. The hydraulic jacks supporting each of the support segments are preferably interconnected so as to permit an equalizing of the loading of all of the segments. The support surfaces are further provided with self-leveling means, specifically rocker plates for counterbalancing any minor inequalities in the support surfaces.

13 Claims, 19 Drawing Figures

BALANCED SUPPORT PLATES

This invention is directed to means for supporting relatively heavy weights from a series of transversely movable, horizontal support surfaces, which are narrow relative to the supported surface. The support members are structurally independent but operatively connected such that the relatively heavy load is maintained in a balanced position. This invention is especially adapted for use in the support of the extremely lengthy and heavy dredge pipeline used in the recovery of ore material from the abyssal ocean floor.

With the recognition that terrestrial sources for raw materials, especially ores, are being swiftly depleted, effort has been made to obtain these valuable industrial raw materials from other sources, one being especially the abyssal depths of the oceans. Such raw materials, especially metal ores, are often found at depths of between 10,000 and 18,000 feet below the surface, requiring extremely deep water dredging means. The most valuable ores found to date are known as ocean floor nodule ores, or manganese nodules. These nodules are often found as relatively small particulate forms, including fist-sized rocks or smaller pebbles, or even as grains of sand. Sometimes solid shelves of these materials are found which would have to be broken up in order to be obtained.

A great deal of engineering effort has been undertaken to date to develop mechanical means to mine such ores and to bring the ores to the surface for further processing. One system now under development for carrying ocean floor ores to the surface of the ocean comprises a dredging vehicle, operating at or near the ocean floor, and a water-lift system, wherein the ore particles are carried upwardly to the surface in a stream of water defined by a length of pipe extending from the undersea dredge vehicle to a surface vessel. This pipe system is generally part of a so-called airlift means, wherein the water within the pipe is caused to flow upwardly by means of injections of air into the pipe at points below the surface.

A serious practical problem encountered in the design and operation of such a mining system arises as a result of the great weight of the dredge pipe string, which is of high strength, relatively thick, steel piping, extending for distances of, generally, from about two to three-and-one-half miles. The pipe is generally formed from a series of relatively short lengths of pipe, several hundred individual lengths, or sections, making up the total dredge pipe string. Necessary support for the dredge pipe string must be accomplished not only during the time when the entire pipe string is in place and dredging occurs by moving a dredge vehicle along the ocean surface, but also during so-called "tripping", when the pipe string is being let down to the ocean floor, i.e., by adding individual lengths one at a time and gradually permitting the pipe string to thus descend towards the ocean floor, or when the pipe is being brought in, i.e., individual lengths of pipe are serially removed from the pipe string and stored, while the dredge pipe length is gradually being shortened and the dredge vehicle brought to the surface of the ocean.

One method for supporting the pipe string during these various periods, includes a series of support plates, arranged circumferentially around the uppermost end of the pipe string, and having resting thereon a radially outwardly extending horizontal ledge, formed by an enlarged end hub on the uppermost section of pipe. In actual practice, such an enlarged hub or ledge is formed at the ends of each of the pipe lengths, and as the pipe is tripped upwardly or downwardly, the support plates contact the end ledges on successive lengths of pipe, thereby supporting the entire length of pipe, extending from the ship downwardly towards the ocean floor. The great mass of this pipe results in weights of several millions of pounds being supported by the support plates, when the pipe is completely extended. The great weight thus being supported, makes it absolutely essential that the pipe be evenly supported around its circumference, such that there is no uneven stress exerted between the support plates and the pipe ledge, which would create a torsion moment capable of cracking even the strongest pipe wall at the joint. It has been necessary to accurately machine all of the support plates, and, perhaps even more arduous, each of the pipe ledges, on each of the several hundred lengths of pipe, must be carefully machined to exact tolerances. Further, each of the support plates must be carefully placed upon the primary support platform, so as to be of equal height to that of all the other support plates. These present serious practical problems, which can greatly increase the cost, and increase the problems encountered in actual practice, unless they are resolved.

In accordance with the present invention, there is provided means for supporting extremely heavy weights from a horizontal, downwardly facing ledge surface, the means comprising an array of relatively narrow structurally independent support segments, preferably wherein each segment is in contact with not more than one-half of the ledge surface. The independent segments extend on either side of the centerline of the object being supported, so as to maintain the object in balance. Each of the support segments is reciprocally movable between a position beneath the horizontal ledge and a position beyond the horizontal ledge; the movement being preferably radially inwardly and outwardly, reciprocally relative to the centerline of the heavy weight being supported. One end portion of each support segment is pivotally supported by a main support platform. The second end portion of each support segment is floatingly supported by a biasing support means, the biasing support means being operatively interconnected so as to maintain a substantially uniform and equal unit load upon all of the support segments. Preferably, the bias support means is provided by a series of operatively interconnected self-levelling support members, at least one member supporting each segment of the horizontal support surface.

The segmented, perimetric, reciprocally movable, horizontal support segments, preferably support a downwardly facing, horizontal ledge extending outwardly from the circumference of a main dredge pipe. Such downwardly facing support ledges are commonly formed on each pipe length, interconnected to form the downwardly extending dredge pipeline. In one preferred embodiment, the individual support member is a hydraulic piston and cylinder unit, each of the hydraulic units being interconnected with all other hydraulic units supporting other support segments. The individual hydraulic units are so calibrated that each of the support segments support loads proportional to the percentage of the perimeter of the supported weight in contact with that segment relative to the proportion supported by each of the other segments. The segments preferably contact equal proportions of the perimeter.

The invention defined herein is exemplified by the embodiments described hereinbelow and depicted in the accompanying drawings. The preferred embodiments are presented herein to provide a more clear understanding of the invention and its advantages, and not to limit the scope of the invention.

Figure 1:
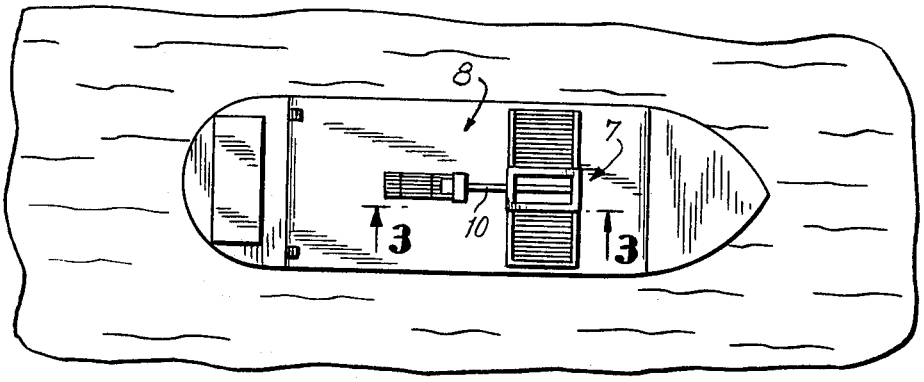
FIG. 1 is a diagrammatic plan-view of an ocean-going vessel fitted for ocean floor mining operations.
Figure 2:
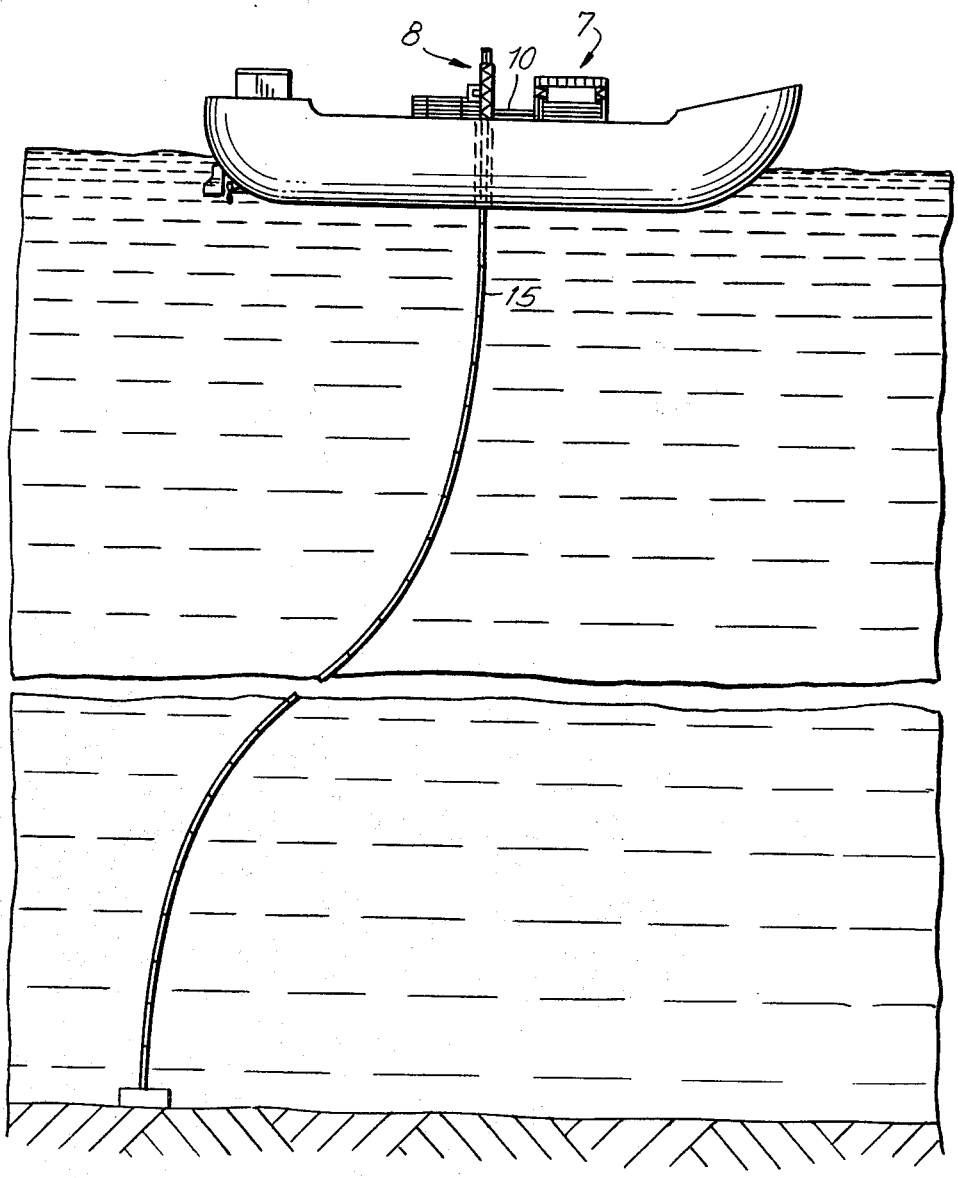
FIG. 2 is a side elevation of the vessel of FIG. 1 including a downwardly extending pipe string extending towards the ocean floor.
Figure 3:
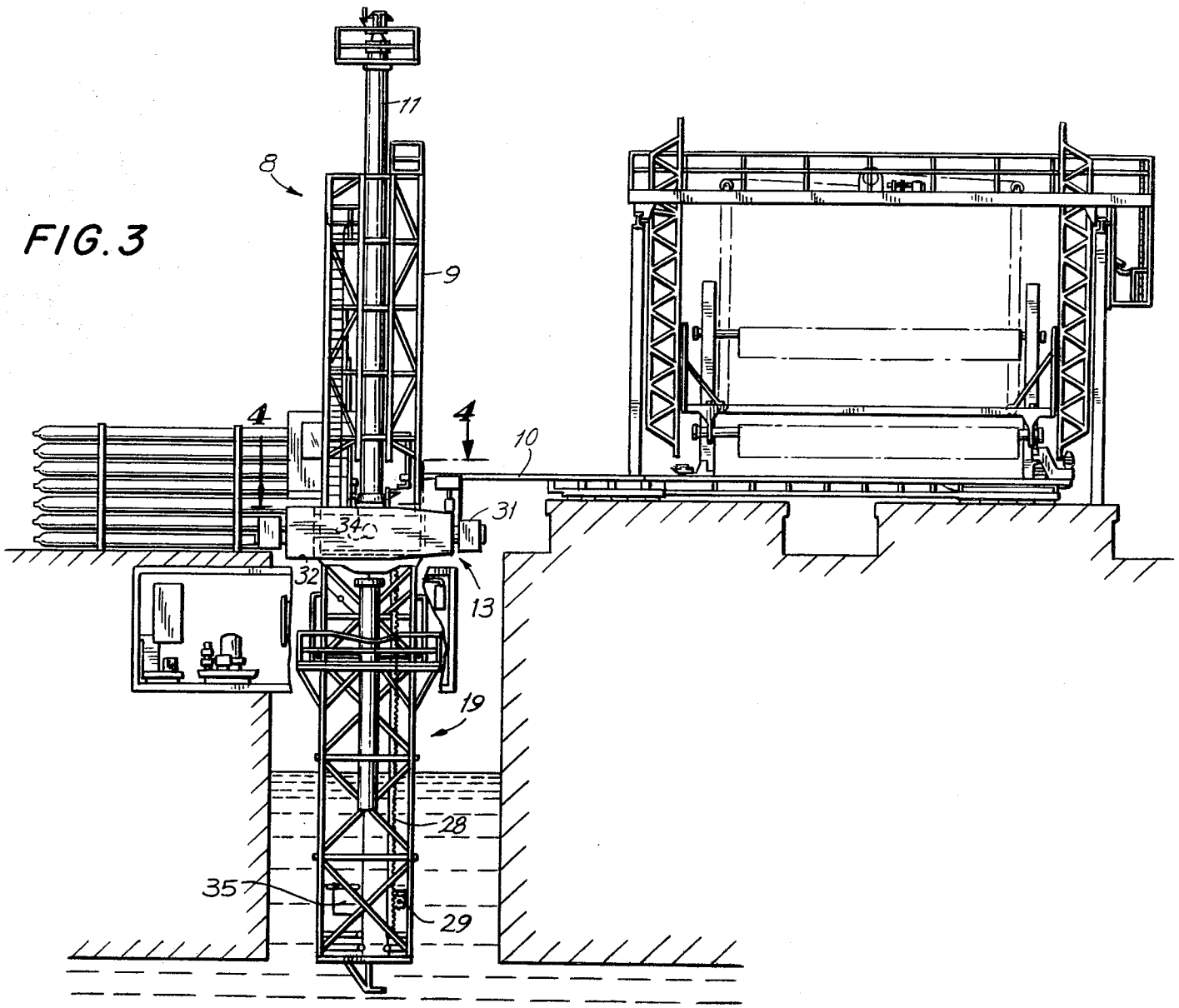
FIG. 3 is a side elevation view of the portion of the vessel of FIGS. 1 and 2 comprising the primary ocean floor dredge line supporting apparatus.
Figure 4:
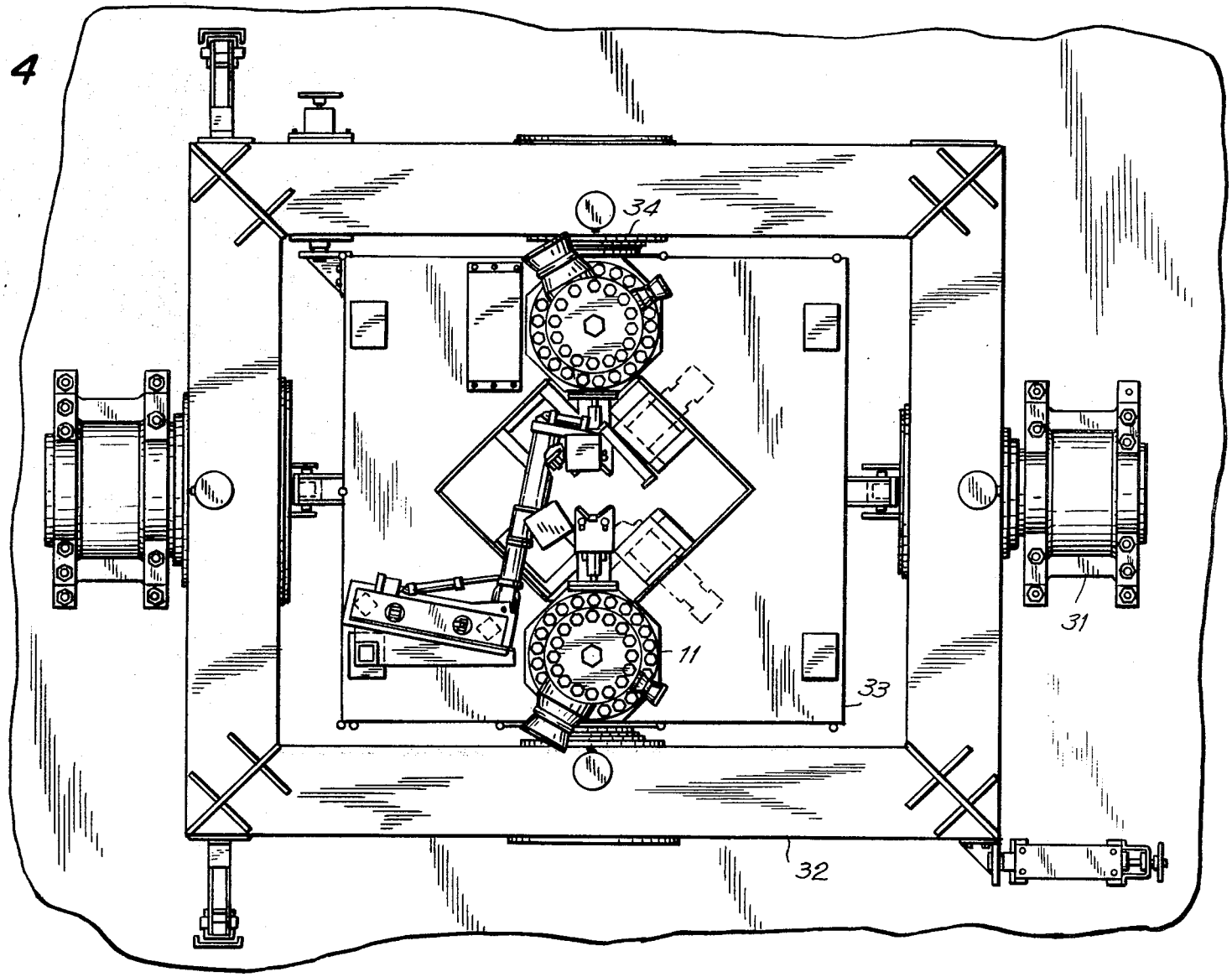
FIG. 4 is a top plan view of a gimbaled platform on the ship.

FIGS. 1 and 2 show a plan and side elevational view of an ocean-going vessel structured specifically for use in ocean floor mining operations. Unusual features on this vessel, distinguishing it clearly from ordinary ocean-going vessels, are shown in the drawings. These special features include a large central opening, or well, extending from the deck of the vessel through the bottom of the vessel. The well is fully enclosed having interior wall surfaces maintaining the integrity of the vessel's hull covering. Extending above the well opening, is a superstructure which can be generally called a derrick, its location being generally indicated by the numeral 8. The derrick 8 and associated pipe handling system are mounted upon a platform which is pivotable relative to the vessel about two horizontal, transverse (substantially perpendicular in this case) axes. The derrick 8, including its associated systems, rests upon an inner gimbaled platform 33, which is pivotally supported by a gimbal axis 34 to an outer gimbal ring 32 which is in turn pivotally supported on an outer gimbal axis 31, connected to the surface vessel and being in the same plane as, but perpendicular to, the inner gimbal axis 34. The derrick 8 is thus pivotally connected to the surface vessel about two perpendicular axes, able to compensate for the pitch and roll of the vessel under even the extreme conditions met with on the ocean surface. Thus, the derrick 8 is permitted to remain substantially continuously vertical, regardless of the pitching and rolling motion of the vessel. As can be generally seen from the drawings, the outer gimbal axis and the inner gimbal axis are preferably substantially located along the longitudinal centerline and the lateral centerline of the vessel, so as to minimize the effect of the rolling and pitching motion in causing relative movement between the gimbaled inner platform and the vessel. The vertical axis of the derrick, is thus located at the substantial centerpoint of the vessel, i.e., the intersection of the longitudinal and lateral axes. FIG. 2 shows the dredge pipe string extending downwardly from the vessel to the ocean floor, trailing behind the vessel as the vessel is continuously moving, pulling an ore gathering device at the end of the dredge pipeline resting on the ocean floor.

The derrick 8 comprises a pair of main hydraulic hoist cylinders 11, supported by the inner gimbaled platform 33, and extending upwardly therefrom. The axis of rotation of the platform 33 extends along the diameters of both of the hydraulic hoist cylinders 11, i.e., the cylinders 11 are centered on the axis.

The main hoist piston rods 12 extend downwardly from, and are slidably connected inside of, the main hoist cylinders 11. Suspended from the main hoist piston rods 12, is a main hoist platform 35 which moves together with the piston rods 12, in a vertical direction towards and away from the gimbaled platform 33. The two hoist cylinders are hydraulically interconnected, in a manner known to the art, to maintain, as much as possible, the movable hoist platform 35 in an even position, i.e., the two hoist piston rods 12 move together in an upwardly and downwardly direction.

Supported downwardly from the inner gimbaled platform 33, is a lower derrick structure, generally designated by the numeral 19, which surrounds the space through which the movable platform 35 moves. Supported on the lower derrick structure 19 is at least one, and preferably a pair, of tracks having square-cut teeth formed along one surface thereof. The tracks extend preferably on either side of the movable hoist platform 35 along the derrick structure 19. Rotatably secured to opposite ends of the movable platform 35 and so placed as to be in contact with the square-cut teeth on the track 28, are pinion gears 29 having square-cut teeth complementing those formed on the track 28. The gears 29 and track 28 are in contact during the vertical movement of the hoist platform 35.

Figure 7:
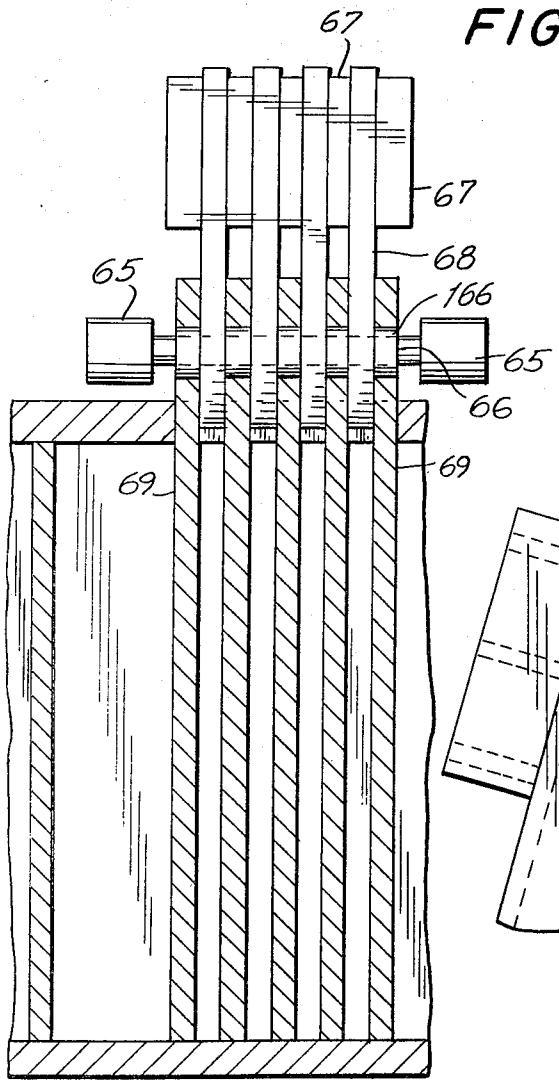
FIG. 7 is a cross-sectional view taken along lines 7—7 of FIG. 6.

Secured to the upper surface of the movable hoist platform 35, and substantially centered thereon, are four segmented pipe support means, generally indicated by the numerals 60 and 61, in FIGS. 5–8. A central opening, defined by surface 20, is formed through the center of the platform 35. Each pair of pipe support means 60, 61 are secured, around opposite sides of the central opening 20, to the platform 35. The pipe support means includes a series of slotted track members 69 extending upwardly from the surface of the platform 35 and rigidly secured thereto, extending through the upper surface and into the main structure, as shown in FIG. 7.

The slotted tracks 69 are interleaved with track brackets 68, which are slidably secured between the slotted tracks 69. The track brackets 68, at their upper end, are in turn rigidly secured to and interleaved between plate fingers 67, which are in turn an integral part of one end of the pipe supporting segments 62, 64.

Pivotably secured to each of the track brackets 68 and extending through the slots formed in slotted tracks 69 is a slide pivot pin 66. The pivot pin also is pivotally secured through a slide member 166 which is slidably secured within each of the slots through the slotted tracks 69. Pivotably secured to each end of the pivot pin 66 is a hydraulic drive piston rod 65 which in turn is slidably connected into a radial drive hydraulic cylinder 63, the second end of the cylinder 63 being pivotally secured to the upper surface of the movable hoist platform 35.

The second end of the pipe support segments 62, 64 are each of a massive, solid configuration, and are supported upon a balancing hydraulic jack, or dashpot, piston 71, which in turn is slidably supported within a balancing dashpot cylinder 70 rigidly secured to the upper surface of the platform 35.

Figure 9:
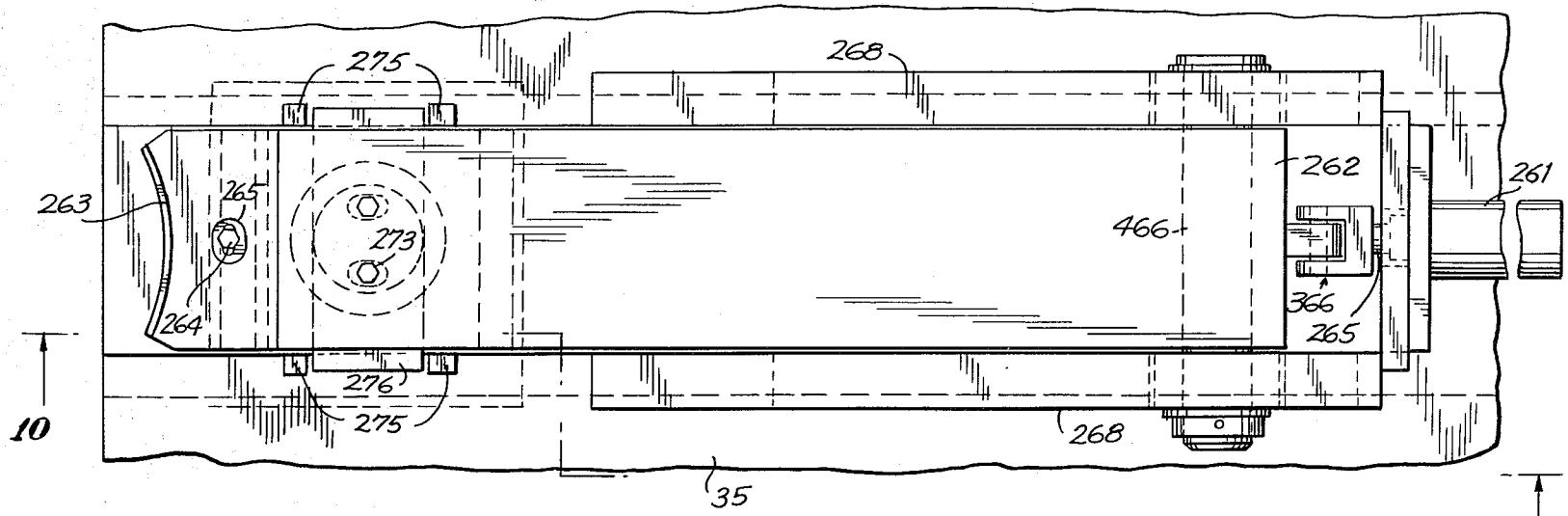
FIG. 9 is a top plan view of one segment of an alternative support platform to FIG. 5.
Figure 10:
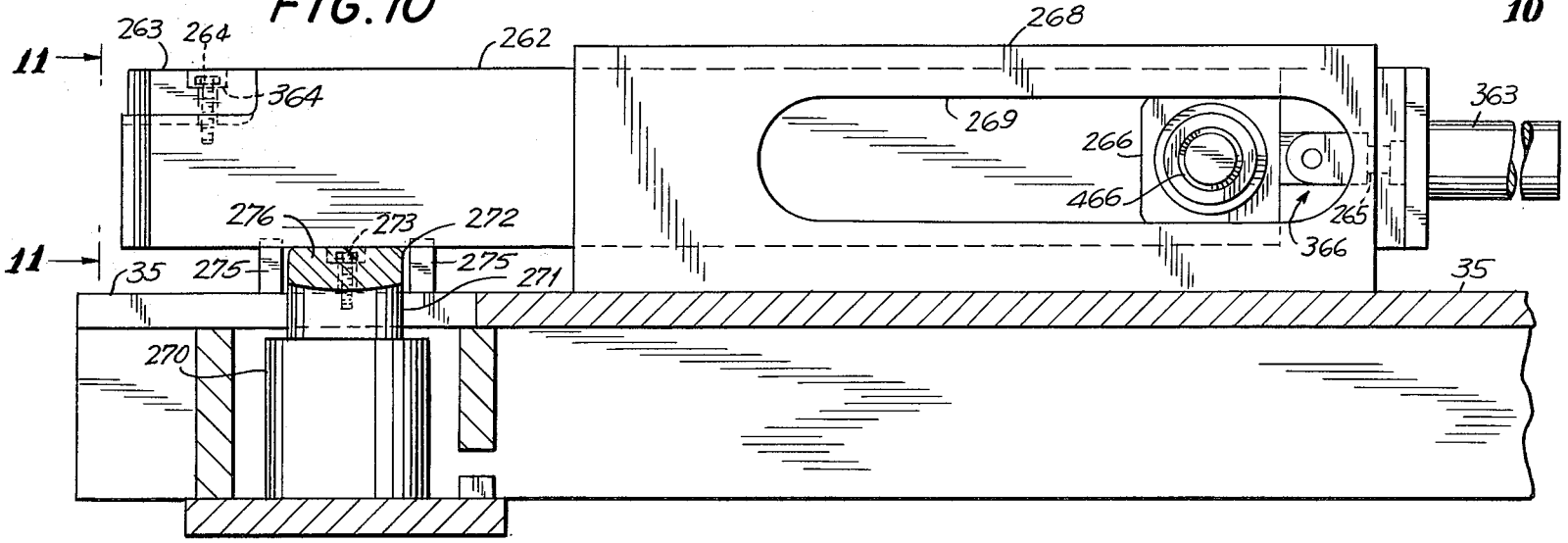
FIG. 10 is a section view taken along lines 10—10 of FIG. 9.
Figure 11:
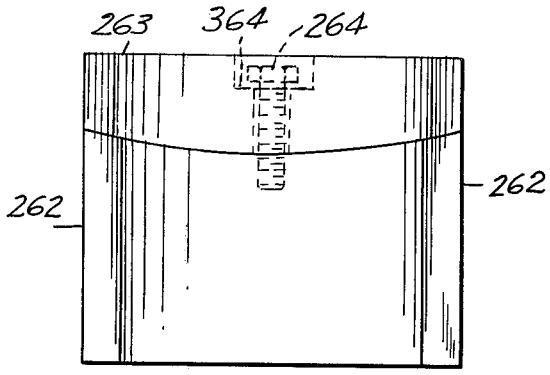
FIG. 11 is a section view taken along lines 11—11 of FIG. 10.

Alternative segmented pipe support means are shown in FIGS. 9–11, which provide for additional balancing means to compensate for dimensional variations in the support ledges on the heavy object being supported.

Secured to the upper surface of the movable hoist platform 35, and substantially centered thereon, are four segmented pipe support means, one of which is shown in FIGS. 9–11. These four segments are secured about the central opening, defined by surface 20, formed through the center of the platform 35, in a manner similar to that shown in FIG. 5.

Each pipe support segment includes a pair of slotted track members 268 extending upwardly from the surface of the platform 35 and rigidly secured thereto. A pipe support member 262 is slidably secured between each pair of slotted tracks 268. Extending transversely through the radially outward end of each support member 262, is a pivot pin 466. The pivot pin also is pivotally secured to a slide member 268 within the slots defined by surfaces 269. Pivotably secured to the radially outer end of the support member 262, by pin joint 366, is an hydraulic drive piston rod 265 which is in turn slidably connected into a radial drive hydraulic cylinder 261.

The radially inward end of the pipe support member 262, each of a massive, solid configuration, is supported upon an hydraulic jack, or load supporting piston 271, which in turn is slidably supported within an hydraulic load supporting cylinder 270, which may be called a dashpot, rigidly secured to the platform 35, adjacent the central opening therethrough.

On either side of the cylinder 270 are lateral supports 275, rigidly secured to the platform 35, and extending on either side of the support member 262. The lateral supports 275 are to prevent excessive rocking of the rocker plate 276.

The radially inwardmost upper end surface of the support member 262 includes a rocker plate supported on a cut-away curved concave surface, having a centerline of curvature in line with the longitudinal centerline of the support member 262. The rocker plate 263 is secured to the support member 262 by a bolt 264 threadedly secured to the support member 262 but passing through an elongated oversize hole in the rocker plate 263, elongated in a transverse direction, perpendicular to the longitudinal centerline. The head of the bolt 264 also has vertical clearance relative to the countersunk surface 364. There is also, desirably, less play in the longitudinal direction. In this fashion, the plate 263 can rock, about an axis parallel to the longitudinal centerline of the support member 262, but substantially cannot move longitudinally along the centerline. The rocker plate can have as much as $\pm 2\frac{1}{2}$ degrees freedom, but preferably needs only about $\pm 1\frac{1}{2}$ degrees of freedom.

Supported from the lower horizontal surface of the gimbaled platform 33 are four segmented pipe support means, generally indicated by the numerals 90, 91, in FIGS. 12–15. These four support means 90, 91 are located in paired configurations, at opposite sides of a central opening through the gimbaled platform 33. Rigidly secured to and extending upwardly from the lower surface of the plate 103, defining the lower surface of the gimbaled platform 33, are a series of relatively closely spaced track plates **98, 98*a*. Interleaved with the track plates 98, 98*a* are upper ends of a series of slide connectors 99. The lower ends of slide connectors 99 are rigidly secured to horizontally extending pipesupporting segments 92, 93, at a slotted central portion of such segments 92, 93. The rigid connection between the slide connectors 99 and each segment 92, 93, as well as the connection between the track brackets 68 and the support plates 62, 64, can be, for example, a series of rivets passing through the various plates and the slotted portions of the segments 92, 93, or by welding. In addition, the support segments 92, 93 and the vertically extending slide connectors 99 or track brackets 68**, can be formed as an integral unit, as by casting or machining. The precise method of manufacture is not significant, as long as the connection is rigid.

The two outermost track plates **98*a*, in each set, extend through the main platform plate 103 and extend downwardly on either side of the pipe support plates 92, 93. Each of the track plates 98, 98*a* have a horizontally extending slot, defined by surfaces 110 extending through the track plate. A complementarily shaped slide 97 is slidably held within each slot 110 and is maintained in place by the lateral support of the interleaved slide connectors 99. A slide pivot pin 96 is rotably secured through the slides 97 and through the slide connectors 99 and a pair of bushings 100 located between the outer track plates 98*a* and the outermost slide connectors 99. The outermost end of each support plate 92, 93 is also a solid massive plate, having piston drive pins rigidly secured thereto and extending transversely outwardly from the sides thereof, substantially perpendicular to the direction of extension of the slide connectors 99. The piston drive pins 106 each pass through a slot defined by surfaces 112 formed within the outer track plates 98*a* and the ends of the pins 106 are rotatably secured to an end of a hydraulic drive piston 95. The other end of the drive piston 95 is in turn slidably held within a hydraulic drive cylinder 94, the far end of the cylinder 94 being pivotally secured, by pin 107, to a cylinder connector 108, in turn rigidly secured to the hydraulic support plate 101. The hydraulic support plate is rigidly secured to the main platform plate 103 and to one edge of the track plates 98, 98*a***.

Figure 16:
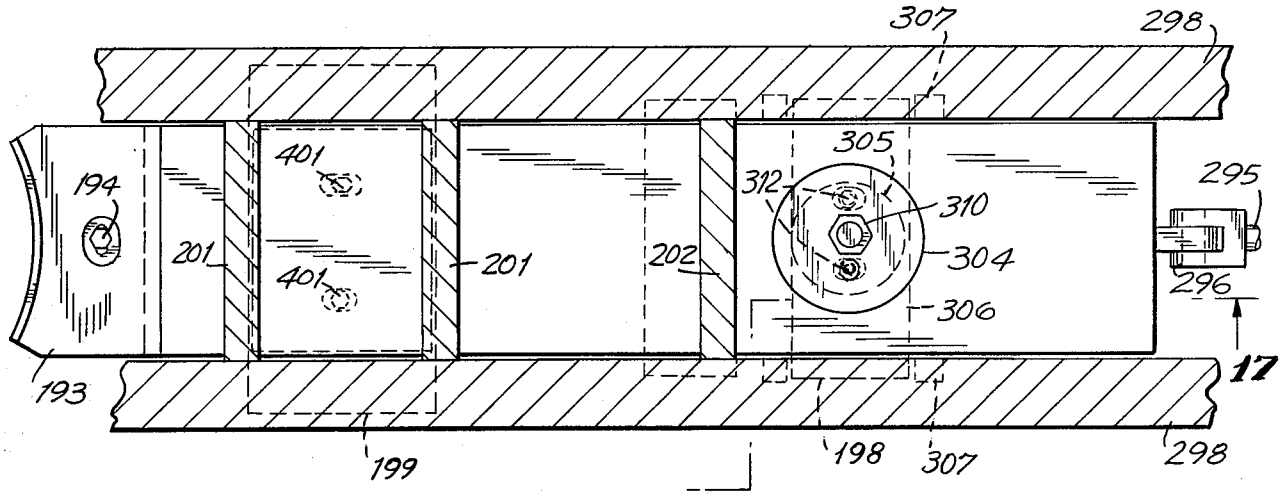
FIG. 16 is a sectional top plan view of one segment of an alternative stationary gimbaled platform to FIG. 12, with a top plate removed.
Figure 17:
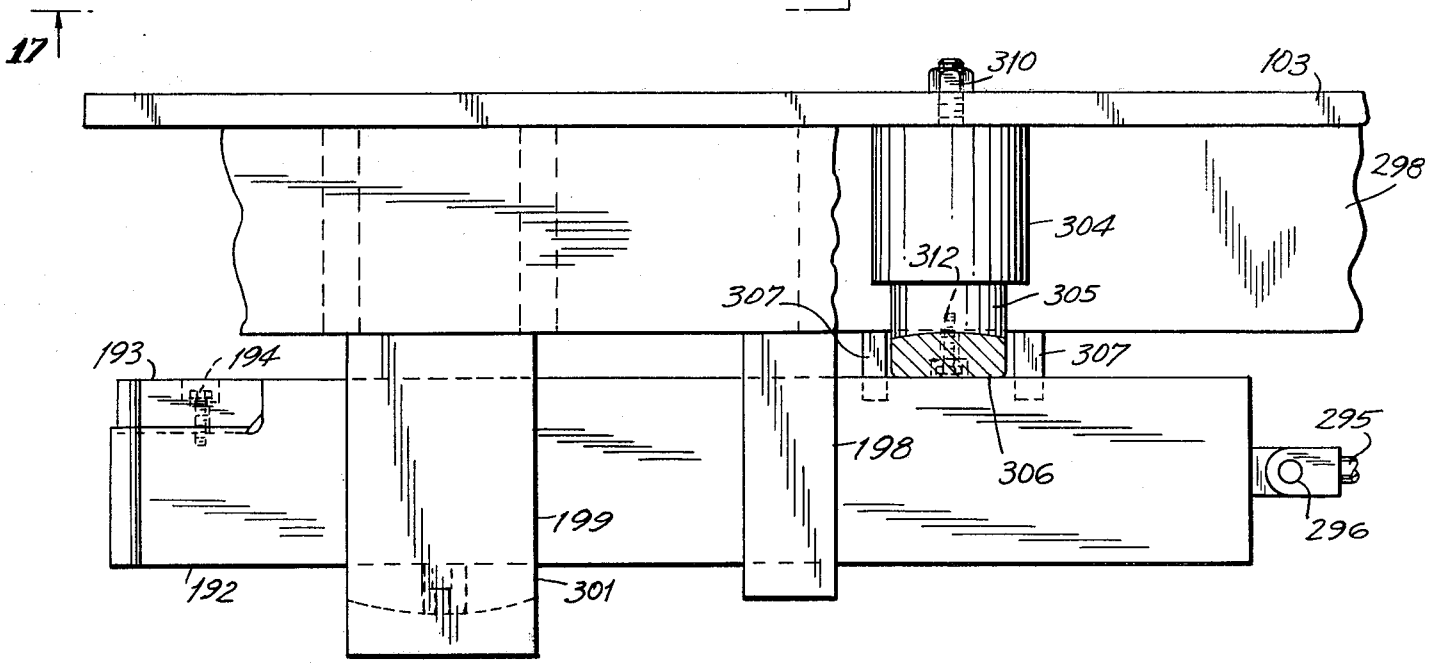
FIG. 17 is a partially sectioned view taken along lines 17—17 of FIG. 16.

Alternative segmented pipe support means supported from the lower horizontal surface of the gimbaled platform 33 are shown in FIGS. 16 and 17. There are preferably four support members 192, distributed around the central opening through the gimbaled platform 33, spaced so as to avoid any obstructions on the pipe string; one member 192 is shown in these drawings.

Rigidly secured to and extending downwardly from the lower surface of the plate 103, defining the lower surface of the gimbaled platform 33, are a pair of substantially parallel track plates 298. The track plates 298 are further braced by transverse connecting members 201 and 202. Extending downwardly from, and rigidly connected to the track plates 298 and connecting members 201 is a major U-shaped support bracket 199, and from connecting members 202 is a secondary U-shaped support bracket 198.

A pipe support member 192 is slidably supported within the brackets 198, 199, resting upon the lower transverse portion of each bracket. In the preferred embodiment shown, a rocker plate 301 is freely secured to the lower transverse portion of bracket 199 so as to permit limited pivoting, or rocking movement, about a transverse axis. The rocker plate 301 is rockably secured to the bracket 199 by screws 401, threadedly secured into the transverse portion of the bracket 199 and passing through oversize, elongated holes through the rocker plate, as is described above for the embodiment of FIG. 11.

The radially outward end of the support member 192 is pivotably secured by a pin 296 to an hydraulic piston rod 295, which in turn is activated by an hydraulic drive cylinder, not shown, secured to the plate 103. The upper surface of the support member 192 extends beneath the lower surface of an hydraulic jack, or dashpot, piston 305, which in turn is slidably connected into a dashpot cylinder 304, secured to the plate 103 by bolt 310. In the preferred embodiment shown herein, the lower portion of the hydraulic piston 305 is freely secured to a rocker plate 306 by screws 312, in a manner as explained above for plate 301, so as to permit limited rocking motion about a transverse axis between the plate 306 and piston 305.

Extending downwardly from and rigidly secured to the tracks 298, are four lateral support pins 307. The support pins 307 extend at least below the upper surface of the support member 192. The lateral support pins 307 are to prevent excessive rocking of the rocker plate 306.

The radially inwardmost upper surface of the support member 192, i.e., the portion intended to contact the supporting surface, comprises a rocker plate, freely secured to the member 192 by a screw 194. The screw 194, is threadedly secured to the member 192 and passes through an oversize, elongated hole in the rocker plate. The oversize hole is elongated in a transverse direction so as to permit rocking motion about a longitudinal axis.

Figure 18:
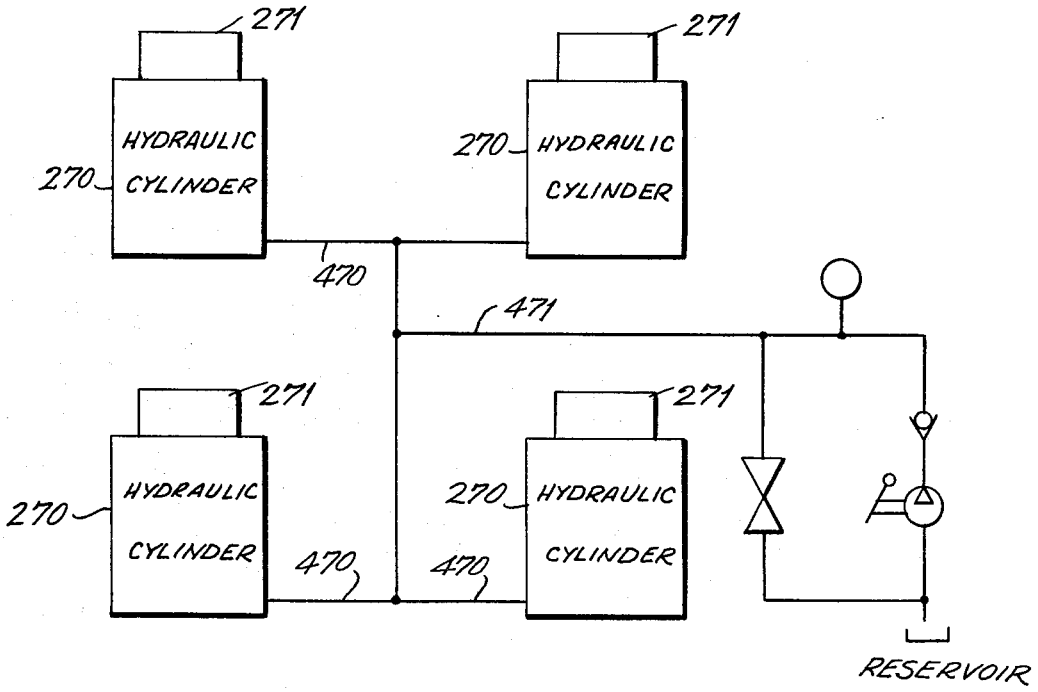
FIG. 18 is a schematic sketch of a hydraulic RAM, or cylinder, system for use herein.

FIG. 18 depicts the hydraulic connections for the support member jacks or dashpots on the moving platform 35; however, the substantially identical hydraulic interconnections apply for the dampers on the gimbaled platform 33. All of the hydraulic ram, or dashpot cylinders 270 are interconnected, by lines 470, to a common hydraulic link 471 to an hydraulic fluid reservoir. The hydraulic fluid pressure is adjusted such that the total weight of the pipe string is supported by the four dashpot pistons 271 in an intermediate position of travel in the cylinder 270.

OPERATION OF THE SYSTEM

Referring to FIGS. 1 to 4, an ocean-going vessel is shown moving at a relatively slow pace, with a dredging pipeline extending beneath and behind the vessel, as the vessel moves in a forward direction. The length of pipe 15, is supported by primary pipe string support member 192, 92, supported from the inner gimbaled platform 33, which is in turn supported by the hydraulic piston rods 12. When the pipe string 15 is supported by the pipe support members 192, 92, the pipe string is vertically fixed relative to the ocean-going vessel. However, when the pipe string is supported by pipe support members 262,62 the pipe string is vertically movable relative to the ocean-going vessel. In this system, pipe 15 having the general configuration shown in Application Ser. No. 910,425, filed on May 30, 1978, including a main dredge line pipe and a secondary air line pipe, plus a pivotable splitter plate pivotally connected to the secondary air line pipe, forms at least a portion of the dredge pipeline 15. The dredge pipeline 15 is formed of individual segments of pipe, for example, approximately 30 feet long, connected together by joints, or hubs, at each end of the individual lengths, to form the dredge pipeline 15, which in usual ocean dredging operations has a total length of about 15,000 feet.

Figure 19:
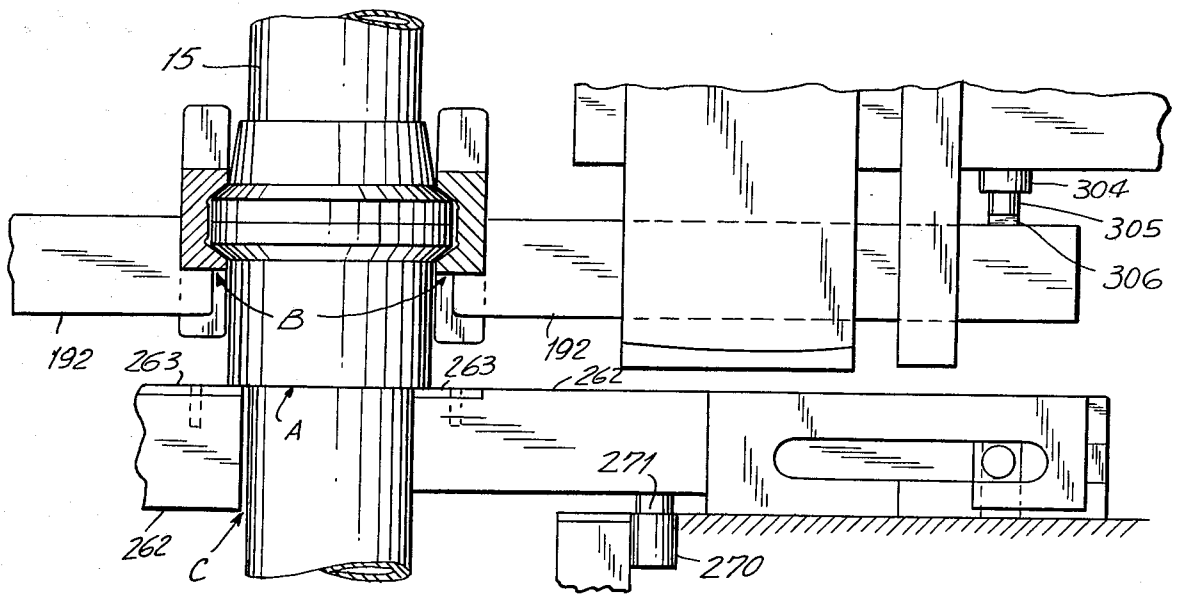
FIG. 19 is an enlarged elevation view, in section, showing the close juxtaposition of the two sets of support segments, supporting a dredge pipe string.

The two support members, specifically the support members 262,62 on the movable platform and the support members 192, 92 on the gimbaled platform 33, are used alternately, especially during what is known as "tripping" of the pipe, i.e., the gradual letting down, or bringing up, of the individual pipe lengths, as the dredge pipe string is lowered from the surface vessel to the ocean floor. One system for transferring pipe from a storage location on the vessel to the pipe string, is shown in commonly assigned Application Ser. No. 108,122 filed Dec. 28, 1979: "PIPE TRANSFER SYSTEM MEANS". An individual pipe length is transferred by such means from the pipe storage area to the derrick 8, where it is held in a vertical position while the lower end of the pipe is secured to the upper end of the pipe string, which is in turn held by the pipe support members 192, 92, 93, supported from the lower surface of the gimbaled platform 33. After the pipe is secured, the hydraulically lifted platform 35 is moved upwardly by the hydraulic piston rods 12 until it is located immediately below the gimbaled platform such that the pipe support members 262, 62, 64 can be moved under a second ledge on the pipe hub, as is shown in FIG. 19. The second ledge is indicated by the initial "A" in FIG. 19. When the support members 262, 62, 64 are in place supporting the pipe from the lower ledge of the pipe hub, the upper pipe supporting members 192 are withdrawn and the pipe string can then be moved downwardly along the lower derrick 19, as the movable platform 35 moves downwardly, until the upper end of the new pipe length is in the proper relation to the upper support members 192, 92, such that the pipe supporting members 192, 92 can be moved into position to support the pipe string beneath the upper ledge "B" of this next pipe hub.

The individual pipe supporting members 262, 62, 64 and 192, 92, 93 on the movable and gimbaled platforms, respectively, are moved radially inwardly and outwardly, relative to the pipe hub by the hydraulic drive piston rods 265, 295. Considering the supporting members 262, 62, first, the members are shown in a supporting position, in FIG. 5, and in FIG. 19, beneath the lower pipe hub. As shown, the ends of the supporting segments 62, 64 are maintained out of contact with the circumference of the pipe, by a distance shown as "C" in FIG. 19. This permits the self-balancing action to take place, as explained below. When the upper members 192, 92, are in position to support the pipe clamp ring B, the supporting members 262, 62, are withdrawn by activating the radial drive hydraulic cylinders 63, such that the piston rods 65, 261 move the supporting members 62, 64, 262, radially outwardly away from beneath the hub ledge A. The members 62, 64, 262 slide over the dashpot piston surfaces 71, 271, as they are drawn away from the pipe hub. The members 62, 64 are moved radially and maintained in alignment by the interleaving of the brackets 68 with the slotted tracks 69. The segments 62, 64, can thus be slid radially inwardly and outwardly from a position beneath and away from the clamp ring B.

The support members 262 are maintained in lateral alignment by the slotted track members 268 and lateral guide pins 275 as they are moved radially inwardly and outwardly by the hydraulic piston rods 263. The members 262 rest only upon the piston rocker plate 272 and the pin-and-slide members 262–264. When pipe is supported by support members 262, the alignment of the pipe string is enhanced by the rocking motion permitted to the rocker plates 263, 272. Although as much as $2\frac{1}{2}$ to 3° of freedom can be permitted, it has been found that $1\frac{1}{2}$° of freedom movement is usually sufficient to compensate for any unevenness of the hub surface, in the case of the end plate 272, or of any warping of the support members 262, in the case of the piston rocker plate 272.

When the full weight of the dredge pipeline is supported by the four support members, of whichever type shown in the drawings, it is important, as explained above, to maintain a relatively even distribution of weight on all four members, and thus an even distribution of force exerted around the pipe support ledge, or perimeter. Although such even distribution can be obtained by a careful aligning and machining of the upper surfaces of the support members, e.g., members 62, 64 and an equally careful machining of all of the pipe hub ledges along the entire pipe string, those are extremely arduous requirements, and would significantly increase the cost of production of such equipment. The present system eases the burden of machining each of the plate pipe hub ledge surfaces, and of preliminarily aligning the various pipe support plates, on the platforms, by providing self-balancing features whereby any inequality or unevenness, within the limits of the operation of this system, can be counterbalanced or equalized by a repositioning of the support members.

For example, in accordance with this invention, any inequality in the support provided for pipe hub ledge A, e.g., among the support members 262, is counterbalanced by a change in the position of the upper surface of any of the members 262, obtained by vertical movement of the support pistons 272, and/or rocking movement by the rocker plates 263, 276. The load support cylinders 270 are all so adjusted and hydraulically interconnected, as shown in FIG. 18, that each of the members 262 support an equal load, regardless of any unevenness on the pipe hub ledge A or misalignment of the upper surfaces of the supporting members 262. A suitable cylinder and piston combination can be provided for counterbalancing any such unevenness up to a range of about ±0.5 inch vertical movement by the pistons 271. This counterbalancing effect also compensates for changes in total weight during tripping of the pipe, as the support members 262 are put into contact with, and thus provide support for, additional pipe lengths. The total hydraulic pressure provided must, of course, be changed, e.g., increased as the pipe string is lengthened and becomes heavier when tripping down. Thus, it is not necessary that all of the pipe hubs B be machined evenly and equally, in order to maintain a substantially uniform force upon the pipe support members 262 and to thus prevent any undesirable, net torsional stress on the pipe at the point of connection with the supporting pipe hub. The rocker plates in the embodiment of FIGS. 9 to 11, and 16 and 17, provide for further relief from any unevenness arising during manufacture or as the result of great stress during periods of load.

The support members which are supported from the lower surface of the stationary gimbaled platform 33, operate in a fashion similar to that of the support members supported on the upper surface of the lower movable platform. The support members 192, 92, 93 are moved radially inwardly and outwardly away from and towards the upper hub of the dredge pipeline, by the hydraulic drive piston rods 295, 95, respectively, operated, e.g., by the hydraulic cylinders 94, attached to a source of hydraulic pressure not shown. All of the four piston and cylinder combinations for each set of the pipe supporting means on the movable platform 35 and gimbaled platform 33, operate simultaneously, and in the same radial direction, i.e., inwardly and outwardly. Longitudinal movement of the hydraulic drive piston rods 295, 95 radially inwardly towards the pipe pushes the supporting plate 192, 92 towards the pipe and into a position beneath the clamp ring B on the pipe hub.

The forces on all of the support members 192, 92, 93 should be balanced in a manner similar to that as described above. The dashpot cylinders 304, 104 are so calibrated and hydraulically interconnected that the forces acting on the ends of the support members 192, 92 are equalized, thus preventing the net torsional stress that can damage the connection between the pipe and the hub. An excess of weight pushing downwardly on the end, e.g., of a support member 192, causes a force exerted upwardly against the hydraulic piston 305, and thus against the fluid in the hydraulic cylinder 304. This force is immediately distributed among all four of the cylinders 304, as a result of the hydraulic interconnections shown in FIG. 18, and thus redistributed substantially equally among the four support members 192. Moving the radially outer end of a support member 192 in a downward direction, by a dashpot piston rod 305, causes pivoting of the segment 92 about the support bracket 199, and thus an upward movement of the inner end of the support member 192. A complementary pivoting motion occurs about the pivot pin 296 connecting the radial drive piston rod 295 to the support member 192. The rocker plates 306 and 301 tend to accommodate this transfer rocking motion and any other unevenness created as described above. The end rocker plate 193 absorbs unevenness or unequal weight distribution in a transverse direction.

When desiring to transfer the pipeline to the movable platform 35, the lower support members 262 are brought into position beneath the lower ledge of the pipe hub, the upper support members 192 are all simultaneously withdrawn, radially outwardly, by action of the piston rods 95. The entire weight of the dredge pipe line 15 is then supported on lower support members 262 and can then be moved downwardly by the platform 35. As the pipeline weight is applied to the lower support members 262, the members pivot about the slide pin 466 and press downwardly upon the hydraulic piston 271.

In the reverse direction, when "tripping" up, i.e., bringing the pipeline up to the vessel, the pipe string is held by the lower ledge A of the pipe hub, by the support members supported on the moving platform 35, at the lower end of the lower derrick 9. The movable platform 35 moves upwardly, moving the dredge pipeline upwardly until the clamp ring B is in position immediately above the upper support members, e.g., 192. The upper support members 192 then move radially inwardly until the rocker plates 193 are beneath the ledge B; the pipeline is then gently lowered by the platform 35 until the ledge B rests upon the support members 192, and the lower support members 162 then move radially outwardly.

Figure 5:
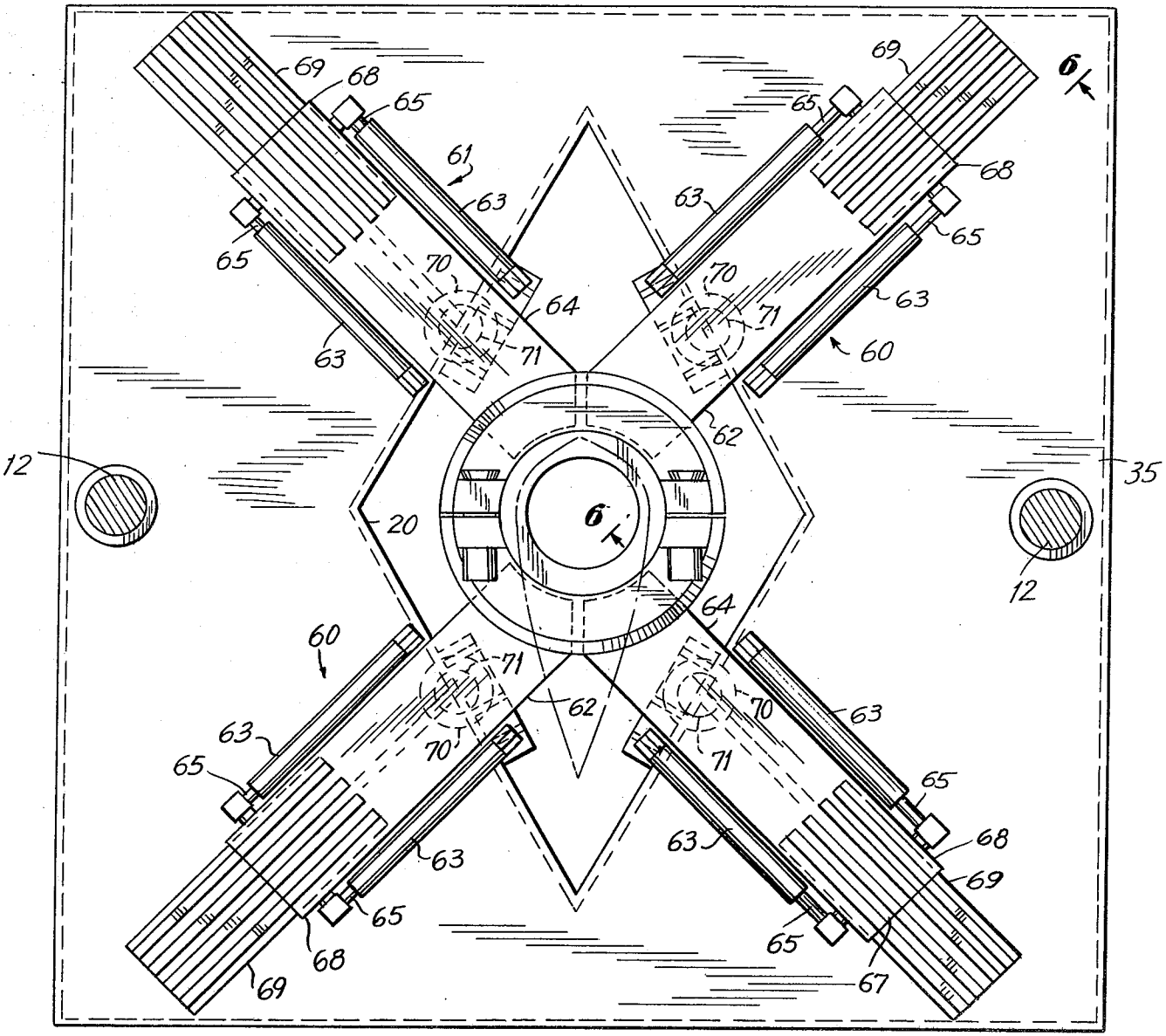
FIG. 5 is a top plan view of a vertically movable support platform.
Figure 6:
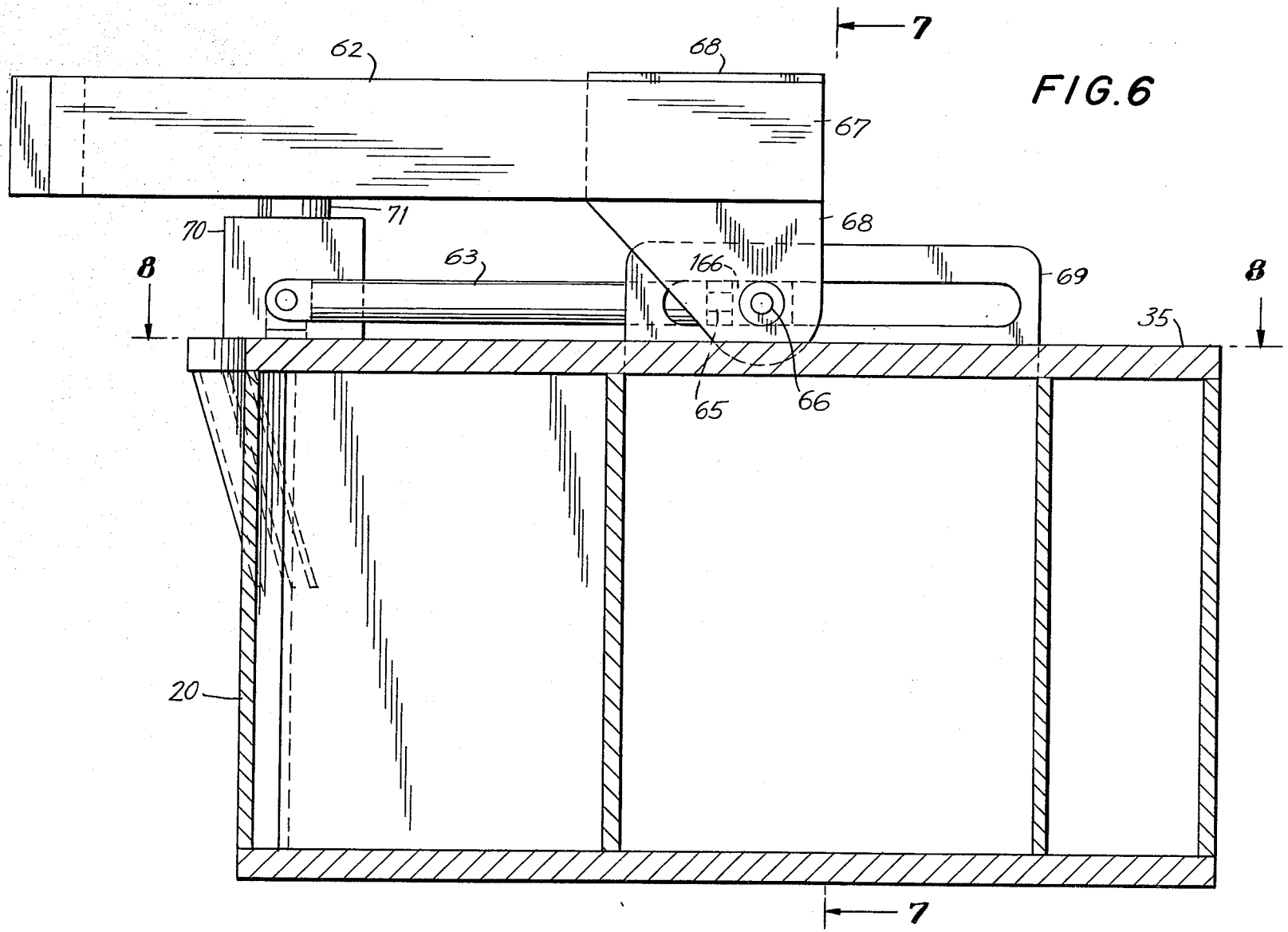
FIG. 6 is a cross-sectional view taken along lines 6—6 of FIG. 5.
Figure 8:
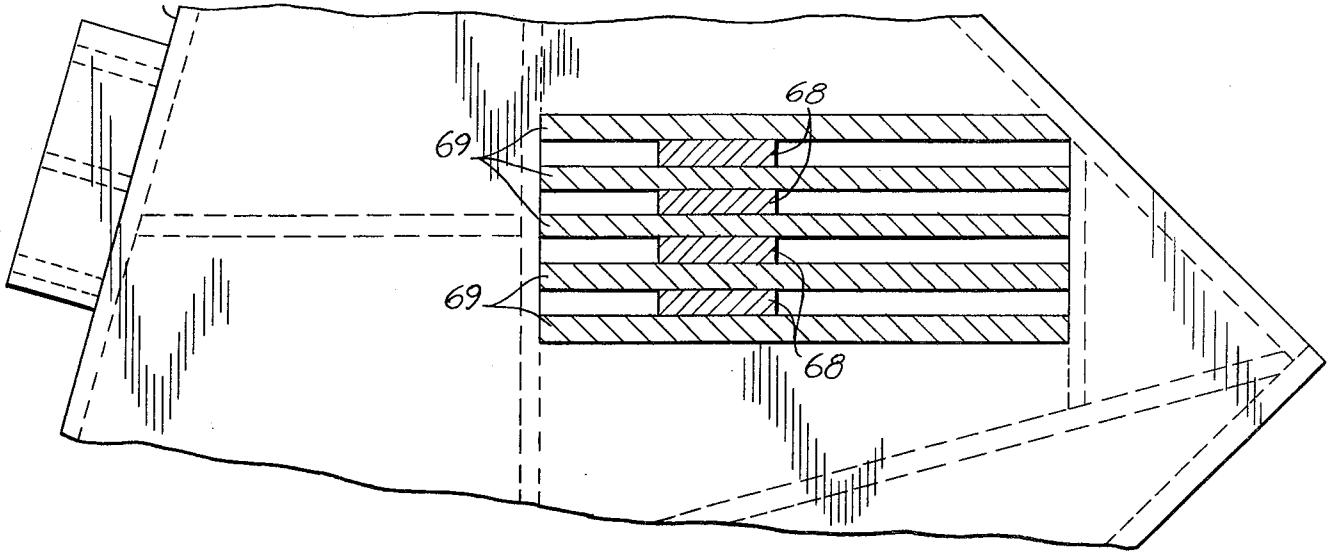
FIG. 8 is a cross-sectional view taken along lines 8—8 of FIG. 6.
Figure 12:
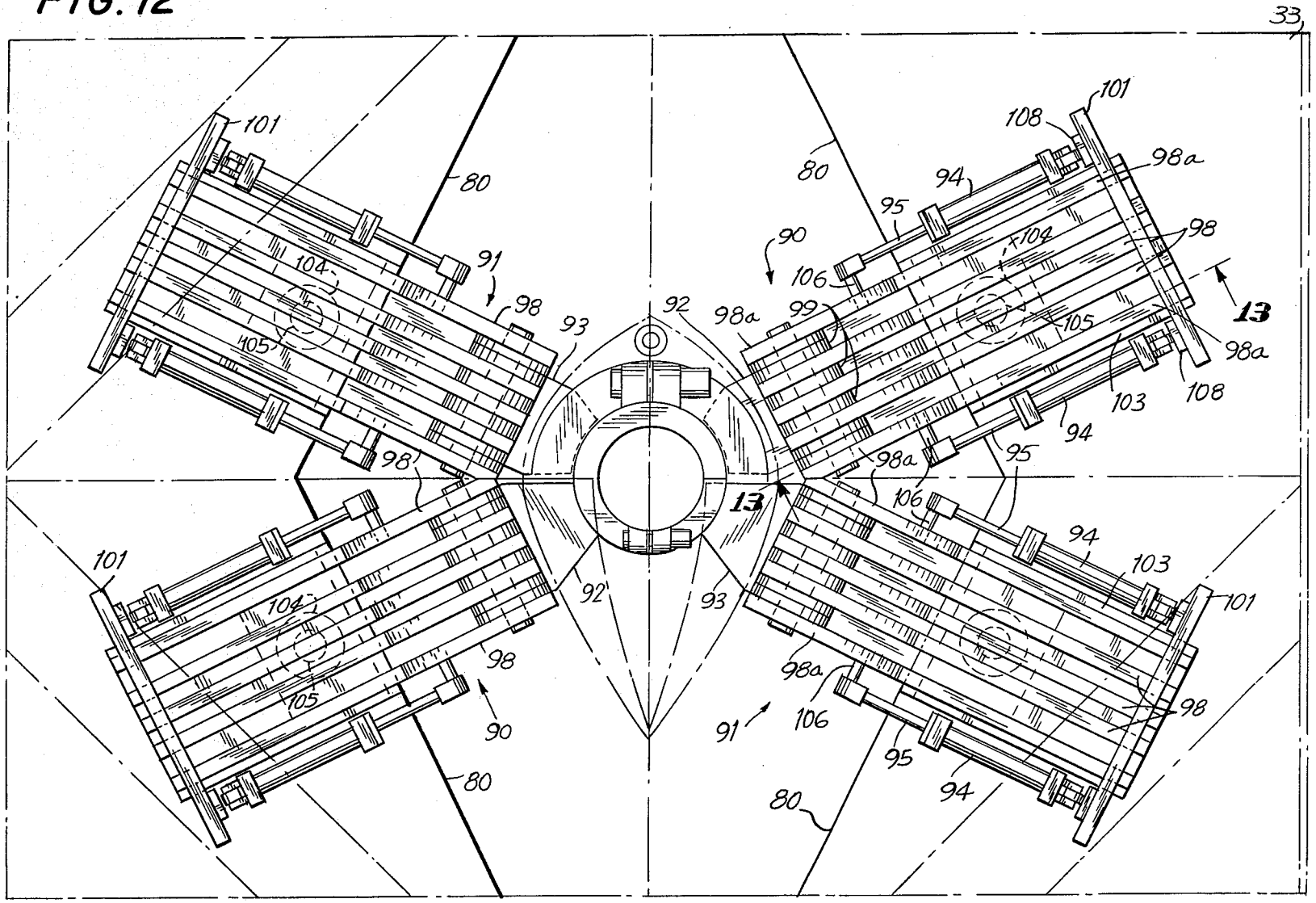
FIG. 12 is a plan view of a stationary gimbaled platform, supporting the movable platform.
Figure 13:
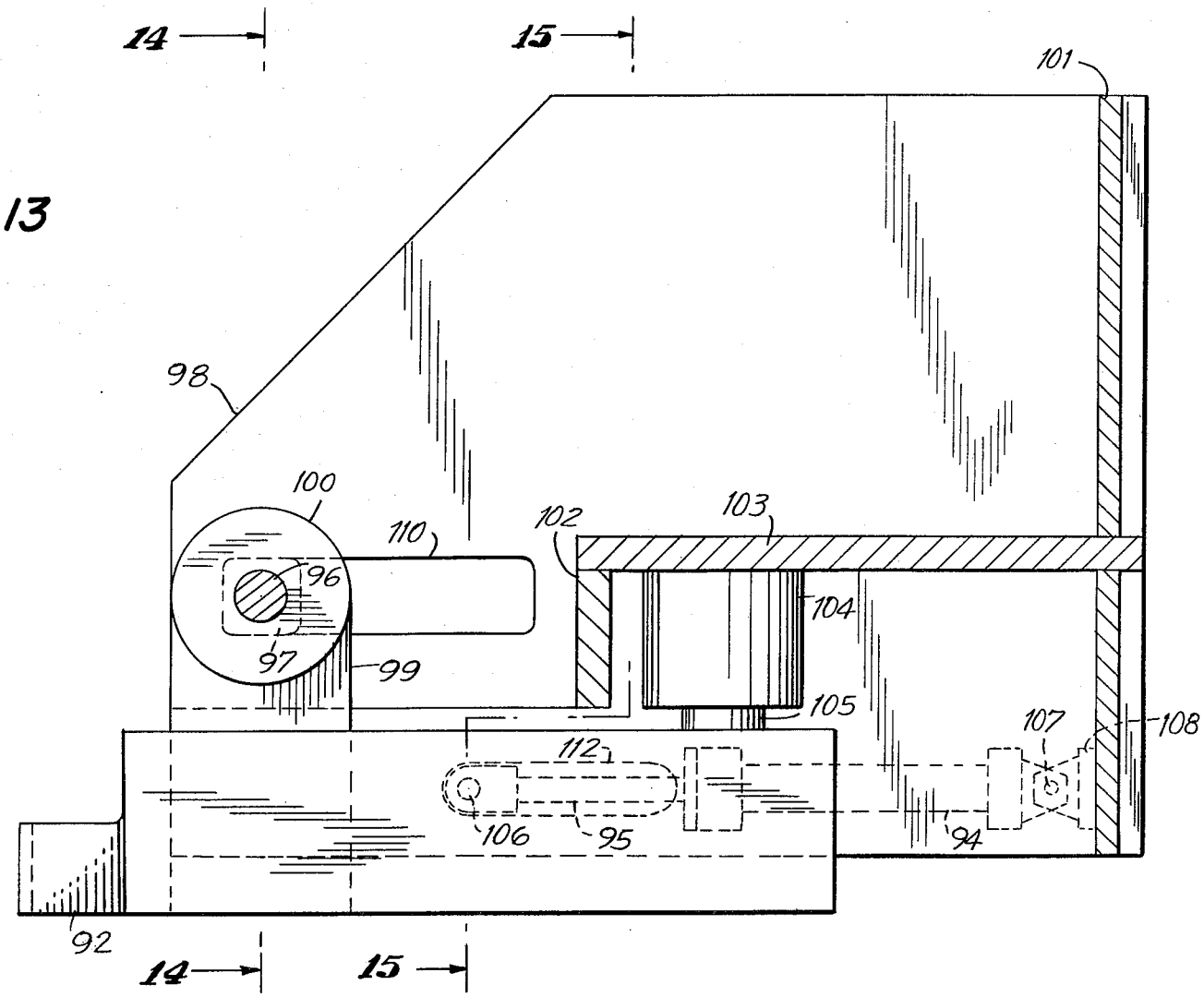
FIG. 13 is a sectional view taken along lines 13—13 of FIG. 12.
Figure 15:
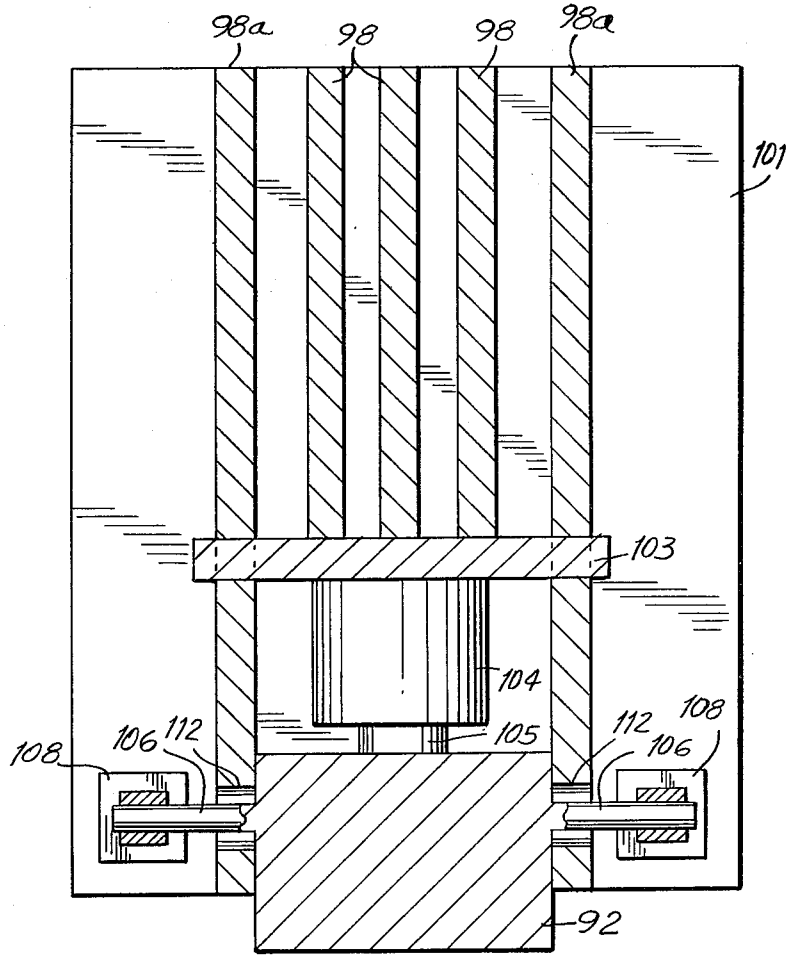
FIG. 15 is a cross-sectional view taken along lines 15—15 of FIG. 13.
Figure 14:
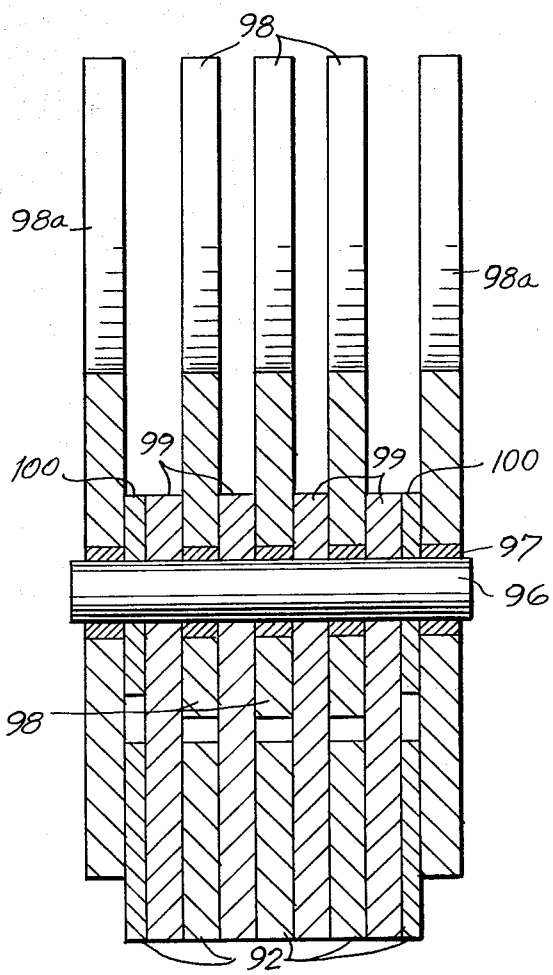
FIG. 14 is a cross-sectional view taken along lines 14—14 of FIG. 13.

All of the support members must be capable of being moved radially outwardly a sufficient distance not only to clear the pipe hubs, but also to clear any fairing or other obstruction, such as a splitter plate, that is connected along the pipe section at locations intermediate the two pipe hubs, at the ends of each pipe section. As is explained in copending Application Ser. No. 108,122, filed Dec. 28, 1979 to "PIPE STRING LIFT SYSTEM", these pipes may have connected thereto either one or more splitter plates, extending radially outwardly from the outer circumference of the pipe, or a fairing completely surrounding the pipe, and thus enlarging the effective diameter of the intermediate portion of the pipe, in certain directions equal to or larger than the diameter of the pipe hub ends. FIGS. 5 and 12 depict a fairing, in phantom lines, attached to the pipe.

The supporting plates 92, 93 and 62, 64, and 262 and 192, can be placed in relatively close vertical juxtaposition, i.e., separated only by the distance between the adjoining ledges A,B on the pipe hub, so as to minimize any undesirable net torsion stress that can occur if the supporting plates were more widely vertically separated.

As shown, there are one or two hydraulic drive units operating each of the support members 262, 62, 64, 192, 92, 93. Although these are preferred embodiments, a single hydraulic drive cylinder can be utilized for more than one support member. This, however, can result in a rather complicated mechanical linkage and increases the likelihood of breakdown.

The extent of the radial inward movement of the support members is limited by the outer diameter of the pipe hub. As explained above, it is preferred that the inner end of each of the support members not contact the circumference of the pipe hub B. In order to obtain this desirable spacing, a series of stop mechanisms are provided, for limiting the inward radial movement of the support members. It is also desirable to provide for positive locking mechanisms to prevent outward radial movement of the support members in the event of any accidental hydraulic failure. It is expected that the outer diameter of the pipe in a dredge pipeline will vary, generally decreasing from the surface downwardly to the ocean floor, once the entire dredge pipeline is in place. Thus, during tripping, the radial travel of the supporting members 262, 182 must be varied as different diameter pipes are utilized. This can be readily accomplished by replaceable stop means which are well known in the art, the specific design of which does not form a part of this invention. An example of such stop means are shown in copending application Ser. No. 108,122, filed Dec. 28, 1979, "PIPE STRING LIFT SYSTEM".

The hydraulic dashpot, or jack, is not the sole means by which the support member can be made load-responsive and self-aligning. Any type of system providing for interconnected opposing movable members can be used, including for example, electrical and electromagnetic systems. The sensing means can be, for example, by strain gauges interconnected among the electrically operated or electromagnetically operated self-leveling support means, whereby the supporting surfaces of the support segments can be moved in the same manner relative to the supporting platform, as explained above for the dashpot.

The examples given herein include a load-supporting ledge having a generally circular perimeter. However, any shape perimeter can be handled by this system, including an irregular curvilinear or polyhedral shape, or an internal perimeter, i.e., the supported member surrounds the support members. Further, the system shown herein has the support members evenly spaced around the perimeter and each support member is of substantially equal surface area. This is not required, although it does, of course, simplify the calibration of the interconnected load balancing means. Further, all of the support members need not have a load-responsive active means such as the hydraulic jack, as long as there is a load-sensing means on each support member.

The patentable embodiments of this invention which are claimed are as follows:

1. Support means for supporting relatively heavy weights from a horizontally extending, downwardly facing surface, the means comprising:

(a) a primary support platform;

(b) a plurality of load support members;

(c) connecting means for movably connecting the members to the primary support platform; and (d) balancing means for substantially proportionately distributing the load among the plurality of support members, said balancing means comprising load-responsive connecting means operatively connected between at least one support member and the primary support platform, and sensing means for determining the instantaneous load applied to each support member, the load responsive connecting means causing the vertical movement of the support member, until the load is evenly distributed among the support members, whereby net transverse stress is minimized on an object being supported.

2. The support means of claim 1 wherein the load-responsive connecting means is hydraulically driven.

3. The support means of claim 2 wherein the support members are plate segments disposed around a perimeter, the plate segments extending longitudinally transversely of the perimeter.

4. The support means of claim 3 wherein the load-responsive connecting means is in contact with a connecting portion of each supporting plate segment, and further comprising pivot support means between a pivot portion of each support plate segment and the primary supporting platform, whereby vertical movement of the load-responsive means generates pivotal movement of the plate segment.

5. The support means of claim 3 comprising, in addition, drive means for reciprocally, longitudinally moving the segments towards and away from a supporting position.

6. The support means of claim 5 wherein the longitudinal drive means comprises an hydraulic device connected at one end to the support plate segment and at a second end to the primary support plaform.

7. The support means of claim 5 wherein at least two support plate segments are in a facing relationship and move inwardly towards and outwardly away from each other during longitudinal movement.

8. The support means of claim 1 wherein the support members are supported above the primary support platform.

9. The support means of claim 1 wherein the support members are supported below the primary support platform.

10. Support means for supporting an object having a substantially circular cross-section, such as a pipe length having an enlarged hub portion, the support means comprising:

(a) a plurality of support plate segments designed to be distributed in a suitable manner around the circumference of the enlarged pipe hub so as to permit a balanced support of the object from the enlarged hub portion;

(b) a primary support platform supporting the support plate segments;

(c) load-responsive means between the support plate segments and the primary support platform, the load-responsive means being operatively interconnected so as to maintain a proportional load upon each support plate segment, the load-responsive means comprising:

(i) a pivotable connector between one portion of each plate segment and the primary support platform; and (ii) a load-responsive vertical deflecting means between a second portion of each plate segment and the support platform, whereby an excess proportional load on one or more support plate segments creates a movement of the support plate segments by the vertical deflecting means until the loads on all support plate segments are substantially proportional.

11. The support means of claim 10 comprising in addition translational drive means for moving the support plate segments relative to the primary platform, reciprocally, radially, towards and away from the object to be supported.

12. Support means for supporting relatively heavy objects having a horizontally extending, downwardly facing ledge surface perimeter, the support means comprising:

(a) a primary support platform;

(b) a plurality of support plate segments supported from the primary platform and extending longitudinally transversely to the perimeter;

(c) means for slidably and pivotally connecting one portion of each support plate segment to the primary platform, the connecting means permitting sliding movement in a longitudinal direction; p1 (d) hydraulic load-responsive means operatively connected between a second longitudinatly distant portion of the support plate segment and to the primary support platform;

(e) hydraulic interconnecting means operatively connected to all of the hydraulic load cylinders, whereby the proportional loads exerted against each hydraulic load-responsive means are substantially equalized; and (f) translational drive means connected between the support plate segments and the primary support platform to move all of the support plate segments radially, reciprocally inwardly and outwardly, between a supporting position for the heavy object and out of the supporting position.

13. The support means of claim 12 combined with a second support means, the two support means being in-line and relatively vertically movable.

* * * * *

UNITED STATES PATENT AND TRADEMARK OFFICE

CERTIFICATE OF CORRECTION

PATENT NO. : 4,323,216

DATED : April 6, 1982

INVENTOR(S) : John P. Latimer

It is certified that error appears in the above-identified patent and that said Letters Patent are hereby corrected as shown below:

Claim 12, column 14, line 17, after "direction;" delete "pl".

Claim 12, column 14, line 19, change "longitudinatly" to --longitudinally--.

Signed and Sealed this

***Twenty-second* Day of *June 1982***

[SEAL]

*Attest:*

*Attesting Officer*

GERALD J. MOSSINGHOFF

*Commissioner of Patents and Trademarks*